US008250887B2

(12) United States Patent
MacKay et al.

(10) Patent No.: US 8,250,887 B2
(45) Date of Patent: Aug. 28, 2012

(54) TAMPER RESISTANT LOCK

(75) Inventors: George Allan MacKay, New Glasgow (CA); Michael Glenn Fievet, New Glasgow (CA)

(73) Assignee: J.J. Mackay Canada Limited (CA)

( * ) Notice: Subject to any disclaimer, the term of this patent is extended or adjusted under 35 U.S.C. 154(b) by 195 days.

(21) Appl. No.: 12/788,100

(22) Filed: May 26, 2010

(65) Prior Publication Data

US 2011/0289985 A1 Dec. 1, 2011

(51) Int. Cl.
*E05B 63/00* (2006.01)
*E05B 65/00* (2006.01)

(52) U.S. Cl. ..... 70/1.5; 70/103; 70/114; 70/116; 70/118; 70/120; 70/416; 70/422; 70/493

(58) Field of Classification Search ..... 70/120, 70/118, 109, 419, 422, 493–495, 378, 103, 70/114, 116, 1.5, 416–418
See application file for complete search history.

(56) References Cited

U.S. PATENT DOCUMENTS

| | | | | | |
|---|---|---|---|---|---|
| 1,189,991 | A | * | 7/1916 | Mugler | 70/120 |
| D107,577 | S | | 12/1937 | McGay | D10/42 |
| 2,161,046 | A | | 6/1939 | Hitzeman | 194/205 |
| 2,261,353 | A | * | 11/1941 | Fedele | 70/120 |
| 2,289,838 | A | | 7/1942 | Herschede et al. | 194/226 |
| D152,294 | S | | 1/1949 | Siegel et al. | D20/10 |
| 2,546,433 | A | | 3/1951 | Dick | 368/6 |
| 2,547,272 | A | | 4/1951 | Lawson et al. | 116/282 |
| D166,059 | S | | 2/1952 | Yoss | D10/42 |
| D166,753 | S | | 5/1952 | Jones | D10/42 |
| 2,599,881 | A | | 6/1952 | Woodruff | 368/92 |
| D181,359 | S | | 11/1957 | Jones | D10/42 |
| 2,956,525 | A | * | 10/1960 | Blauvelt | 109/59 R |
| 2,985,978 | A | | 5/1961 | Breen et al. | 40/333 |
| 3,056,544 | A | * | 10/1962 | Sollenberger et al. | 232/16 |
| 3,204,438 | A | * | 9/1965 | Sollenberger | 70/417 |
| 3,486,324 | A | | 12/1969 | Andersson | 368/90 |
| 3,637,277 | A | * | 1/1972 | Krug et al. | 312/217 |
| 3,975,934 | A | * | 8/1976 | Babai et al. | 70/120 |
| 3,991,595 | A | * | 11/1976 | Bahry et al. | 70/120 |
| 4,237,710 | A | * | 12/1980 | Cardozo | 70/108 |
| 4,639,021 | A | * | 1/1987 | Hope | 292/7 |
| D296,795 | S | | 7/1988 | Bouve | D20/10 |
| 4,812,805 | A | | 3/1989 | Lachat et al. | 340/825.05 |

(Continued)

FOREIGN PATENT DOCUMENTS

AU 4035701 9/2001

(Continued)

OTHER PUBLICATIONS

International Search Report, PCT/CA2009/001058, dated Nov. 12, 2009 (4 pgs).

(Continued)

*Primary Examiner* — Lloyd Gall
*Assistant Examiner* — Ifeolu Adeboyejo
(74) *Attorney, Agent, or Firm* — Hayes Soloway P.C.

(57) ABSTRACT

A tamper resistant lock is provided. The tamper resistant lock comprises a primary locking mechanism for locking and unlocking the tamper resistant lock with an appropriate key. A secondary locking mechanism is engaged and prevents unlocking when a sufficient force is applied to the tamper resistant lock. The force may be the result of driving a screwdriver into a keyway of the lock in an attempt to forcefully unlock the lock.

15 Claims, 11 Drawing Sheets

U.S. PATENT DOCUMENTS

| | | | | |
|---|---|---|---|---|
| 4,825,425 | A | 4/1989 | Turner | 368/7 |
| 4,875,598 | A | 10/1989 | Dahl | 221/4 |
| 4,880,097 | A | 11/1989 | Speas | 194/239 |
| 5,065,156 | A | 11/1991 | Bernier | 340/932.2 |
| 5,109,972 | A | 5/1992 | Van Horn et al. | 194/217 |
| 5,155,614 | A | 10/1992 | Carmen et al. | 398/202 |
| 5,222,076 | A | 6/1993 | Ng et al. | 375/9 |
| D340,038 | S | 10/1993 | Venne et al. | D14/420 |
| 5,259,491 | A | 11/1993 | Ward, II | 194/350 |
| 5,266,947 | A | 11/1993 | Fujiwara et al. | 340/932.2 |
| 5,287,384 | A | 2/1994 | Avery et al. | 375/1 |
| 5,360,095 | A | 11/1994 | Speas | 194/217 |
| 5,402,475 | A | 3/1995 | Lesner, Jr. et al. | 379/106 |
| 5,442,348 | A | 8/1995 | Mushell | 340/932.2 |
| 5,454,461 | A | 10/1995 | Jacobs | 194/200 |
| 5,475,373 | A | 12/1995 | Speas | 340/815.58 |
| 5,500,517 | A | 3/1996 | Cagliostro | 235/486 |
| 5,563,491 | A | 10/1996 | Tseng | 320/2 |
| 5,614,892 | A | 3/1997 | Ward, II et al. | 340/870.02 |
| 5,642,119 | A | 6/1997 | Jacobs | 342/69 |
| D381,976 | S | 8/1997 | Sandor et al. | D14/420 |
| 5,659,306 | A | 8/1997 | Bahar | 340/932.2 |
| 5,710,743 | A | 1/1998 | Dee et al. | 368/90 |
| D391,238 | S | 2/1998 | Sakata | D14/420 |
| 5,740,050 | A | 4/1998 | Ward, II | 364/464.28 |
| 5,748,103 | A | 5/1998 | Flach et al. | 340/870.07 |
| 5,805,083 | A | 9/1998 | Sutton et al. | 340/932.2 |
| 5,841,369 | A | 11/1998 | Sutton et al. | 340/932.2 |
| 5,852,411 | A | 12/1998 | Jacobs et al. | 340/932.2 |
| D404,025 | S | 1/1999 | Van Horne et al. | D14/331 |
| 5,903,520 | A | 5/1999 | Dee et al. | 368/90 |
| 5,911,763 | A * | 6/1999 | Quesada | 70/120 |
| D413,311 | S | 8/1999 | Blalock | D14/420 |
| 5,966,345 | A | 10/1999 | Dee et al. | 368/90 |
| 6,037,880 | A | 3/2000 | Manion | 340/932.2 |
| 6,052,453 | A | 4/2000 | Sagady et al. | 379/146 |
| 6,082,153 | A | 7/2000 | Schoell et al. | 70/1.5 |
| 6,111,522 | A | 8/2000 | Hiltz et al. | 340/932.2 |
| 6,195,015 | B1 | 2/2001 | Jacobs et al. | 340/693.9 |
| RE37,193 | E | 5/2001 | Ward et al. | 194/217 |
| 6,230,868 | B1 | 5/2001 | Tuxen et al. | 194/217 |
| 6,275,170 | B1 | 8/2001 | Jacobs et al. | 340/932.2 |
| D448,910 | S | 10/2001 | Kit et al. | D99/28 |
| 6,309,098 | B1 | 10/2001 | Wong | 368/94 |
| 6,312,152 | B2 | 11/2001 | Dee et al. | 368/90 |
| 6,354,425 | B1 | 3/2002 | Tuxen et al. | 194/350 |
| 6,373,442 | B1 | 4/2002 | Thomas et al. | 343/767 |
| D461,728 | S | 8/2002 | Tuxen et al. | D10/42 |
| 6,457,586 | B2 | 10/2002 | Yasuda et al. | 209/534 |
| 6,477,875 | B2 | 11/2002 | Field et al. | 70/491 |
| 6,747,575 | B2 | 6/2004 | Chauvin et al. | 340/932.2 |
| 6,791,473 | B2 | 9/2004 | Kibria et al. | 340/932.2 |
| D497,393 | S | 10/2004 | Herbst | D20/99 |
| 6,823,317 | B1 | 11/2004 | Ouimet et al. | 705/13 |
| 6,874,340 | B1 | 4/2005 | Berman | 7/161 |
| 6,889,899 | B2 | 5/2005 | Silberberg | 235/384 |
| 6,929,179 | B2 | 8/2005 | Fulcher et al. | 235/381 |
| 7,014,355 | B2 | 3/2006 | Potter, Sr. et al. | 368/90 |
| 7,027,773 | B1 | 4/2006 | McMillin | 455/41.2 |
| 7,029,167 | B1 | 4/2006 | Mitschele | 368/90 |
| 7,071,839 | B2 | 7/2006 | Patel et al. | 340/933 |
| 7,104,447 | B1 | 9/2006 | Lopez et al. | 235/384 |
| 7,183,999 | B2 | 2/2007 | Matthews et al. | 345/1.1 |
| 7,237,716 | B2 | 7/2007 | Silberberg | 235/384 |
| 7,253,747 | B2 | 8/2007 | Noguchi | 340/932.2 |
| 7,319,974 | B1 | 1/2008 | Brusseaux | 705/13 |
| 7,330,131 | B2 | 2/2008 | Zanotti et al. | 340/932.2 |
| 7,393,134 | B2 | 7/2008 | Mitschele | 368/90 |
| D575,168 | S | 8/2008 | King et al. | D10/42 |
| D587,141 | S | 2/2009 | King et al. | D10/42 |
| D602,225 | S | 10/2009 | Lute et al. | D99/28 |
| D615,274 | S | 5/2010 | Kim et al. | D99/28 |
| D617,799 | S | 6/2010 | Odhe et al. | D14/420 |
| 7,748,620 | B2 | 7/2010 | Gomez et al. | 235/383 |
| 7,772,720 | B2 | 8/2010 | McGee et al. | 307/66 |
| 7,854,310 | B2 | 12/2010 | King et al. | 194/350 |
| 7,874,482 | B2 | 1/2011 | Mitschele | 235/384 |
| 2001/0012241 | A1 | 8/2001 | Dee et al. | 368/90 |
| 2001/0047278 | A1 | 11/2001 | Brookner et al. | 705/1 |
| 2001/0051531 | A1 | 12/2001 | Singhal et al. | 455/556 |
| 2002/0030606 | A1 | 3/2002 | Chauvin et al. | 340/932.2 |
| 2002/0062172 | A1 | 5/2002 | Bench et al. | |
| 2002/0134645 | A1 | 9/2002 | Alexander et al. | 194/351 |
| 2003/0092387 | A1 | 5/2003 | Hjelmvik | 455/41 |
| 2003/0128136 | A1 | 7/2003 | Spier et al. | 340/932.2 |
| 2003/0144972 | A1 | 7/2003 | Cordery et al. | 705/401 |
| 2003/0179107 | A1 | 9/2003 | Kibria et al. | 340/932.2 |
| 2004/0011099 | A1 | 1/2004 | Andersson | |
| 2004/0039632 | A1 | 2/2004 | Han et al. | 705/13 |
| 2004/0181496 | A1 | 9/2004 | Odinotski et al. | 705/418 |
| 2004/0243526 | A1 | 12/2004 | Krygler et al. | 705/418 |
| 2004/0264302 | A1 | 12/2004 | Ward, II | 368/90 |
| 2005/0155839 | A1 | 7/2005 | Banks et al. | 194/302 |
| 2005/0192911 | A1 | 9/2005 | Mattern | 705/401 |
| 2006/0136131 | A1 | 6/2006 | Dugan et al. | 701/300 |
| 2006/0149684 | A1 | 7/2006 | Matsuura et al. | 705/65 |
| 2006/0152349 | A1 | 7/2006 | Ratnakar | 340/426.1 |
| 2006/0152385 | A1 | 7/2006 | Mandy | 340/932.2 |
| 2007/0016539 | A1 | 1/2007 | Groft et al. | 705/418 |
| 2007/0017265 | A1 | 1/2007 | Andersson | |
| 2007/0044523 | A1 | 3/2007 | Davis | |
| 2007/0094153 | A1 | 4/2007 | Ferraro | 705/67 |
| 2007/0136128 | A1 | 6/2007 | Janacek et al. | 705/13 |
| 2007/0171069 | A1 | 7/2007 | Allen | 340/572.1 |
| 2008/0071611 | A1 | 3/2008 | Lovett | 705/13 |
| 2008/0158010 | A1 | 7/2008 | Nath et al. | 340/932.2 |
| 2008/0165030 | A1 | 7/2008 | Kuo et al. | 340/932.2 |
| 2008/0238715 | A1 | 10/2008 | Cheng et al. | 340/870.03 |
| 2008/0277468 | A1 | 11/2008 | Mitschele | 235/384 |
| 2008/0291054 | A1 | 11/2008 | Groft | 340/932.2 |
| 2009/0049875 | A1 * | 2/2009 | Buhl et al. | 70/52 |
| 2009/0109062 | A1 | 4/2009 | An | 340/932.2 |
| 2009/0159674 | A1 | 6/2009 | King et al. | 235/382 |
| 2009/0192950 | A1 | 7/2009 | King et al. | 705/418 |
| 2010/0030629 | A1 | 2/2010 | Ward, II | 705/13 |
| 2010/0328104 | A1 | 12/2010 | Groft | 340/932.2 |
| 2011/0057815 | A1 | 3/2011 | King et al. | 340/932.2 |
| 2011/0060653 | A1 | 3/2011 | King et al. | 705/14.58 |
| 2011/0203901 | A1 | 8/2011 | King et al. | 194/211 |
| 2011/0205087 | A1 | 8/2011 | Kell et al. | 340/932.2 |

FOREIGN PATENT DOCUMENTS

| | | |
|---|---|---|
| CA | 2233931 | 4/1997 |
| CA | 2260925 | 1/1998 |
| CA | 2227833 | 7/1998 |
| CA | 2346908 | 4/2000 |
| CA | 2352968 | 1/2001 |
| CA | 2377010 | 12/2001 |
| CA | 2437722 | 8/2002 |
| CA | 2413198 | 5/2003 |
| CA | 2414132 | 6/2003 |
| CN | 2395344 | 9/2000 |
| CN | 2544352 | 4/2003 |
| EP | 980055 | 2/2000 |
| EP | 1376491 | 1/2004 |
| GB | 1431862 | 4/1976 |
| GB | 2155228 | 9/1985 |
| JP | 2002099640 | 4/2002 |
| JP | 2005267430 | 9/2005 |
| JP | 2007052773 | 3/2007 |
| KR | 20050038077 | 4/2005 |
| MX | 2008007047 | 8/2008 |
| WO | WO97/12345 | 4/1997 |
| WO | WO98/04080 | 1/1998 |
| WO | WO01/69541 | 9/2001 |
| WO | WO2007063530 | 6/2007 |
| WO | WO2010071974 | 7/2010 |

OTHER PUBLICATIONS

International Search Report, PCT/CA2009/001657, dated Feb. 17, 2010 (2 pgs).

International Search Report, PCT/US2010/047907, dated Apr. 26, 2011 (3 pgs).

International Search Report, PCT/US2010/047906, dated Mar. 30, 2011 (3 pgs).

International Search Report, PCT/IB06/054574, dated Oct. 27, 2008 (2 pgs).
Office Action, dated Dec. 13, 2011 in U.S. Appl. No. 12/973,109 (27 pgs).
Office Action, dated Sep. 14, 2011 in U.S. Appl. No. 12/430,733 (7 pgs).
Office Action, dated Dec. 7, 2011 in U.S. Appl. No. 12/355,734 (31 pgs).
Office Action, dated Sep. 15, 2011 in U.S. Appl. No. 12/355,740 (6 pgs).
Office Action, dated Dec. 20, 2011 in U.S. Appl. No. 12/355,740 (12 pgs).
Office Action, dated Jun. 29, 2011 in U.S. Appl. No. 12/059,909 (21 pgs).
Office Action, dated Jul. 27, 11 in U.S. Appl. No. 12/059,909 (34 pgs).
Office Action, dated Apr. 11, 2011 in U.S. Appl. No. 12/095,914 (3 pgs).
Request for Continued Examination, dated Sep. 27, 2011 in U.S. Appl. No. 12/059,909 (18 pgs).
Request for Continued Examination, dated Mar. 30, 2012 in U.S. Appl. No. 12/355,734 (32 pgs).
(Cell Net Data Systems) "First Wireless Monitoring of Parking Meters Results in Theft Arrests Using CellNet Data Systems Technology," PRNewswire, May 11, 1999 (2 pgs).
StreetSmart Technology, LLC, "Technical Specifications and System Features for the StreetSmart Solution" Brochure (8 pgs).
Meter Solutions, Single-Space Meters brochure, downloaded from www.duncansolutions.com website, revised Apr. 2006 (2 pgs).

* cited by examiner

TAMPER RESISTANT LOCK

TECHNICAL FIELD

This disclosure relates generally to locks and in particular to locks that are resistant to forceful attacks.

BACKGROUND

One of the most common type of lock used today is a cylinder lock. It is often used to secure an interior space of a device in a public area. For example, such a lock may be used to secure a coin vault door or access panel of a parking meter or vending machine. Such a lock may also be used in securing cabinets or other housings, such as electrical or telecommunication cabinets.

Due to their popularity and vulnerability, traditional cylinder locks have been a target of vandals and thieves wishing to gain access to the space being secured by the lock. Cylinder locks may be vulnerable to unauthorized opening through lock picking techniques, or more forceful techniques that break the lock.

As seen in FIGS. 1A to 1D, a traditional cylinder lock 100 in its simplest form is made up of an exterior lock body or housing 102 which is fixedly attached to a panel, door or device 104 it is securing, and an inner longitudinal cylinder 106 which fits into the housing 102. The inner cylinder 106 will normally accept a slotted key 108 into a keyway 110 in the inner cylinder 106.

The inner cylinder 106 is prevented from rotating within the housing 102 by a plurality of spring loaded pins 112 that project between the housing 102 and the inner cylinder 106. Each pin is composed of at least two portions 112*a* and 112*b*, with a shear line 114 created between the two portions. In order to allow the inner cylinder 106 to rotate within the housing 102, all of the pins 112 need to be aligned within the inner cylinder 106 and housing 102 so that the shear line 114 of each pin 112 is aligned with a shear line 116 of the lock where the inner cylinder 106 meets the housing 102.

A key 108 having a specific cut or pattern will cause the plurality of spring loaded pins 112 to be pushed or pulled in or out (the direction depending on the cylinder lock design) of the housing 102 and inner cylinder 106, and to align the shear line 114 of each pin with the shear line 116 of the lock. Once the pins 112 are properly aligned the inner cylinder 106 can freely rotate. Other components may be mechanically coupled to the inner cylinder 106 of the lock to also rotate or disengage allowing a door to be opened or a locked cavity to be accessed when the inner cylinder 106 is rotated.

Most cylinder locks rely solely on the lock pins to prevent the rotation of the inner cylinder in a lock. Although other techniques of unlocking a lock without a key exist, a common method of lock attack, depicted in FIG. 2A, is to forcefully drive the tip of a heavy flat screwdriver (not shown) into the keyway 110 in the inner cylinder 106 with enough force to engage the screwdriver in the keyway 110. Cylindrical locks are typically securely mounted to thick pieces of steel to prevent possible damage from vandals. However, the thick mounting plate also allows the screwdriver to be forcefully driven into the keyway slot of the lock, since the thick mounting plate will not yield under the force. Once the screwdriver is driven into the keyway slot 110, it is forcefully twisted, which rotates the inner cylinder 106 of the lock 100. This forceful motion can cause the lock pins 112 to come hard against the housing 102 of the lock 100 and shear off portion (s) 112*c*, allowing the inner cylinder 106 to freely rotate.

A similar method of lock attack, depicted in FIG. 2B, is to drive the inner cylinder 106 into the housing 102 with enough force to shear off the pins 112. Such methods of subjecting the lock to sufficient forces to shear the pins 112 allow a vandal or thief to gain access to the space secured by the lock.

SUMMARY

In accordance with the disclosure there is provided a tamper resistant lock comprising a primary locking mechanism and a secondary locking mechanism. The primary locking mechanism has a longitudinal cylinder within a housing, the longitudinal cylinder rotatable within the housing, the longitudinal cylinder coupled to an actuator that is rotatable between a locked position and an unlocked position when an appropriate key is received within the longitudinal cylinder. The secondary locking mechanism prevents rotation of the actuator when a tampering force parallel to a longitudinal axis of the longitudinal cylinder is applied to the primary locking mechanism. The secondary locking mechanism, when engaged, couples the actuator to the housing of the primary locking mechanism.

In accordance with the disclosure there is also provided a securable device comprising a body having an interior space to be secured, an access panel in the body and a tamper resistant lock in accordance with the disclosure.

BRIEF DESCRIPTION OF THE DRAWINGS

Tamper resistant locks are described with reference to the drawings. Like numbers are used to denote similar elements throughout the drawings in which.

DETAILED DESCRIPTION

A tamper resistant lock system is described that has a secondary locking mechanism. Attempts to forcefully unlock the tamper resistant lock system by shearing the pins of the lock will engage the secondary locking mechanism and prevent unlocking. Although forceful attacks may damage or destroy components of the cylindrical lock, the secondary locking mechanism, when engaged, prevents the lock from rotating and thus safeguards the contents of the locked space.

Figure 3:
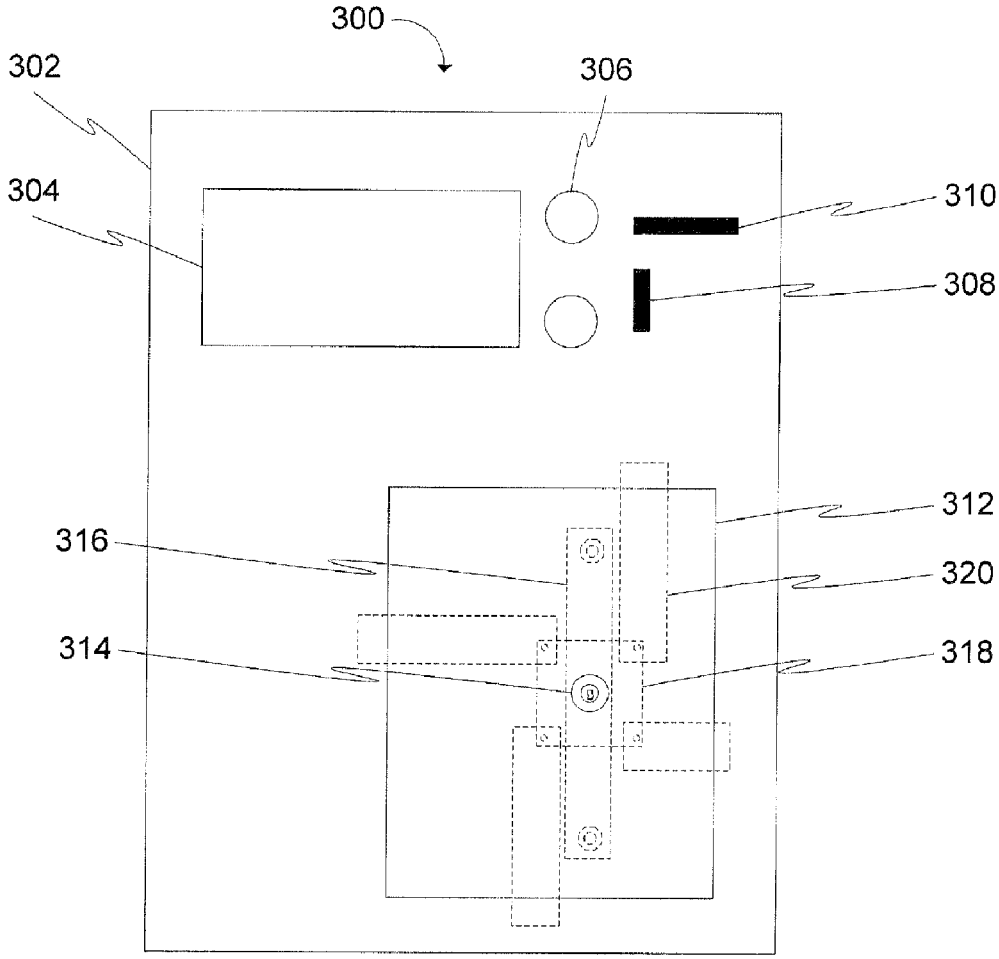
FIG. 3 depicts a device that may be secured by a tamper resistant lock.

FIG. 3 depicts a device 300, such as parking meter. The device 300 is depicted as having a main body 302 housing a display 304 and one or more buttons 306. The device 300 is also depicted has having a coin chute 308 and a cash slot 310 for accepting payment. The deposited money may be stored in an interior vault (not shown). The vault may be accessed through a door 312. The door 312 may include a locking mechanism as depicted, which comprises a cylindrical lock 314 mounted to a mounting plate 316 that is secured to a frame of the door 312. A cam plate 318 may be secured to the cylindrical lock 314 such that when the inner cylinder is rotated, one or more lock bars 320 that are pivotally attached to the cam plate can extend or retract outwardly or inwardly relative to the door 312. Components of the locking mechanism are typically covered by one or more pieces of hardened steel of a door cover.

Figure 4B:
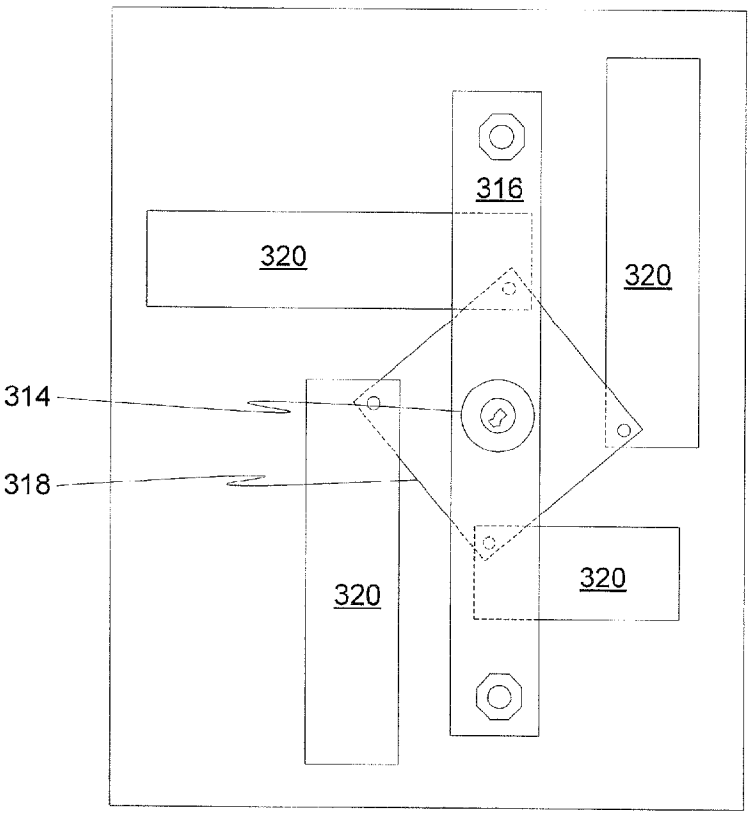
FIG. 4B depicts detail of a locking mechanism in an unlocked position.
Figure 4A:
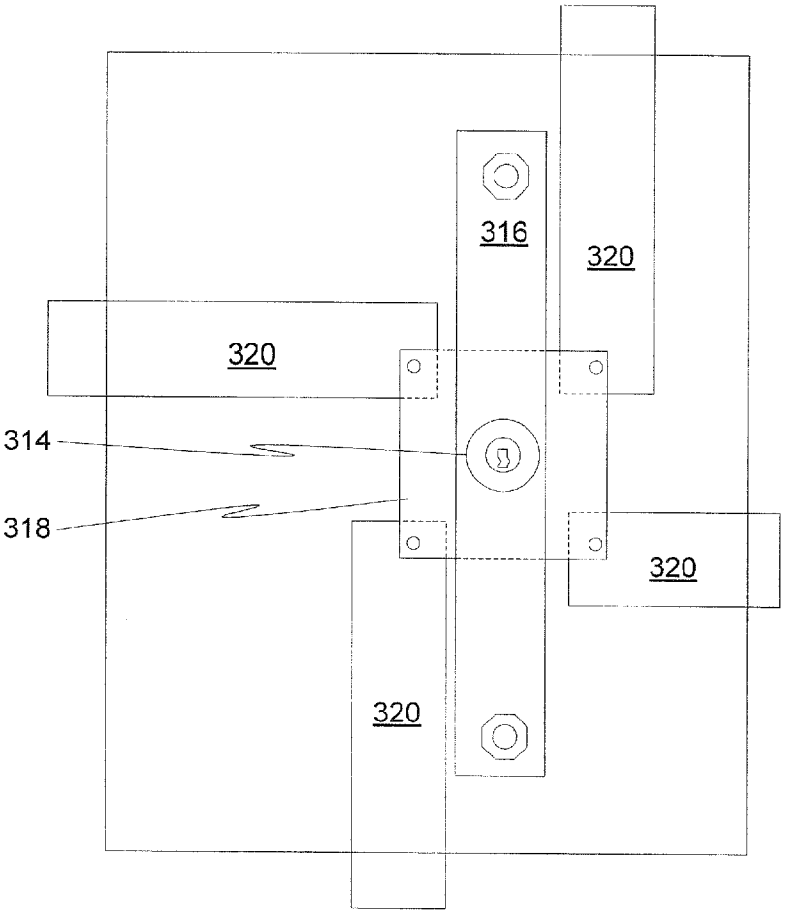
FIG. 4A depicts detail of a locking mechanism in a locked position.

FIG. 4A depicts the locking mechanism in a locked position. FIG. 4B depicts the locking mechanism in an unlocked position. If only the cylindrical lock is present in the locking mechanism, the inner cylinder of the lock can be caused to rotate by forcefully attacking the lock as described above. This will cause the cam plate 318 to also rotate, and so extend or retract the locking bars 320.

The tamper resistant lock system described herein may be used to secure a vault door to a cash box of an unattended parking meter. The tamper resistant lock described herein may also be used in various devices other than a parking meter.

When a vandal attacks the parking meter in the field, they may slide an anti drill cover shielding the lock to the side and then forcefully drive a tip a flat blade screwdriver into the keyway slot of the inner cylinder of the lock. This can be done by using a hammer or sledge to strike the back handle of the screwdriver. The screwdriver must be driven into the keyway slot with sufficient force that it will not come loose when subsequently forcing the inner cylinder to rotate. Alternatively the inner cylinder may be struck with sufficient force to drive the inner cylinder partially through the housing. Both attacks require a substantial amount of force be applied to the inner cylinder.

In order to secure the door, even when the cylindrical lock is forcefully attacked, a secondary locking mechanism is included. The secondary locking mechanism is engaged when a force is applied to the cylindrical lock that is above a threshold. As described further herein, this tampering force causes an interacting component coupled to the inner cylinder to be displaced towards a corresponding interacting component coupled to the housing. The two interacting components, when displaced relative to each other can engage with each other and prevent the cam plate of the tamper resistant lock from rotating and so prevents the tamper resistant lock from unlocking.

Figure 5A:
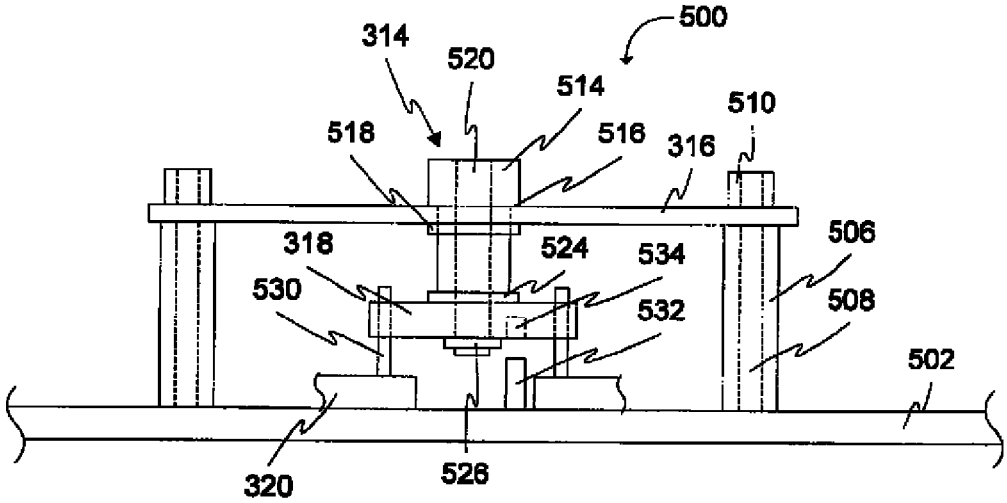
FIG. 5A depicts a tamper resistant lock in which a secondary locking mechanism has not been engaged.

FIG. 5A depicts in a schematic a tamper resistant lock 500 in which a secondary locking mechanism has not been engaged. The tamper resistant lock 500 comprises a primary locking mechanism and a secondary locking mechanism. The primary locking mechanism allows the tamper resistant lock to be locked and unlocked using an appropriate key. The secondary locking mechanism prevents the tamper resistant lock from unlocking when a large force is applied to the primary lock.

The tamper resistant lock 500 comprises a backing plate 502. The backing plate 502 may be part of a frame of a door that is being secured, or part of a housing of a device incorporating the tamper resistant lock 500, or other suitable component. A mounting plate 316 is secured to the backing plate 502 by one or more members 506. As depicted, the members 506 may surround a pin, bolt or similar means 508 fastened to the backing plate 502. A fastener 510, such as a nut or cap, may be used to secure the mounting plate 316 to the member 506. The member 506 displaces the mounting plate 316 from the backing plate 502.

A cylindrical lock 314 may be used as the primary locking mechanism of the tamper resistant lock 500. The cylindrical lock 314 comprises a housing 514 that is securely mounted to the mounting plate 316. The housing 514 may include an exterior lip 516 that is secured against the mounting plate by a nut 518 on the housing 514 tightened on the opposite side of the mounting plate 316. The cylindrical lock 314 further comprises a longitudinal cylinder 520 within the housing 514. The longitudinal cylinder 520 is free to rotate within the housing 514. As will be appreciated, the rotation of the inner longitudinal cylinder 520 is prevented by a plurality of pins that can be aligned to allow rotation of the inner longitudinal cylinder 520 with an appropriate key. A cam plate 318 is secured to the longitudinal cylinder 520. The cam plate 318 may be coupled to the longitudinal cylinder 520 using, for example, a pair of nuts 524, 526 on the longitudinal cylinder 520, or more securely by welding. The cam plate 318 allows the rotation of the longitudinal cylinder 520 to actuate one or more locking bars 320 each rotatably connected to the cam plate 318 through respective connecting pins 530. It will be appreciated that the cam plate 318 is one example of an actuator. Various other actuators may be used in order to actuate the locking bars 320 or other means used to secure the locked space. An actuator may be coupled to the longitudinal cylinder 520, or form a part of the longitudinal cylinder 520 as described further herein.

Rotation of the longitudinal cylinder 520 within the housing 514 may cause the cam plate 318 to also rotate between a locked and an unlocked position. The rotation of the cam plate 318 actuates the locking bars 320 so that they are extended in the locked position, and retracted in the unlocked position.

As described further below, the tamper resistant lock 500 further comprises a secondary locking mechanism for securing the cam plate 318 from rotating when the secondary locking mechanism is engaged. The secondary locking mechanism includes a locking pin 532 that is securely mounted, for example by welding, to the backing plate 502, and is aligned with a corresponding locking hole 534 in the cam plate 318 when the cam plate 318 is in the locked position. The locking pin 532 and corresponding locking hole 534 are longitudinally displaced from each other when the secondary locking mechanism is not engaged, allowing the cam plate 318 to rotate freely with the longitudinal cylinder 520.

Figure 5B:
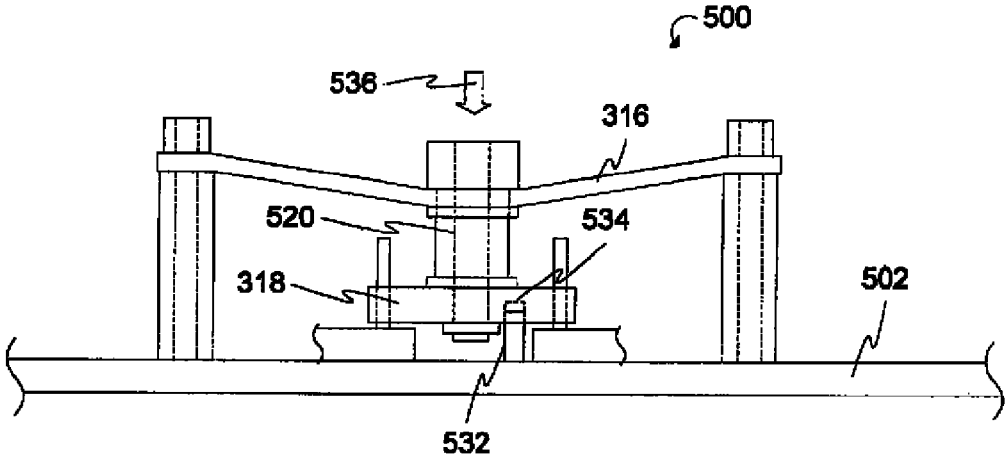
FIG. 5B depicts the tamper resistant lock of FIG. 5A in which the secondary locking mechanism has been engaged.

FIG. 5B depicts the tamper resistant lock 500 with the secondary locking mechanism engaged. The mounting plate 316 is of a thickness that it deforms under a tampering force 536. The tampering force 536 is applied, or has a component, parallel to the longitudinal axis of the longitudinal cylinder 520, which will typically be normal to the plane of rotation of the longitudinal cylinder 520. The tampering force may be generated by driving a screwdriver into the keyway of the longitudinal cylinder 520. When the tampering force 536 is above a threshold sufficient to deform the mounting plate 316, the cam plate 318 is longitudinally displaced towards the backing plate 502. When the mounting plate 316 is deformed sufficiently to allow the locking pin 532 to interact with the locking hole 534 on the cam plate 318, the secondary locking mechanism is engaged. The tampering force may be applied repeatedly in order to deform the mounting plate sufficiently to engage the secondary locking mechanism. Since the locking hole 534 is located off of the center of rotation of the cam plate 318, the cam plate 318 is unable to rotate once the locking pin 532 is interacting with the locking hole 534. The mounting plate 316 acts as an engaging component that allows the cam plate 318 and locking hole 534 to move longitudinally towards the locking pin 532.

The thickness of the mounting plate may be selected so that it will deform when a force greater than a threshold force is applied. The particular threshold of the force required to deform the mounting plate, and so engage the secondary locking mechanism, may be determined based on the requirements of the tamper resistant lock 500.

Figure 5C:
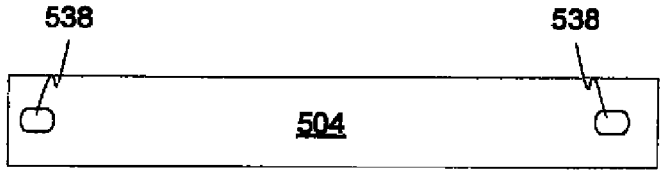
FIG. 5C depicts a mounting plate that may be used with the tamper resistant lock of FIGS. 5A and 5B.

FIG. 5C depicts a top view of a mounting plate 316 that may be used with the tamper resistant lock 500. Instead of having circular mounting holes, the mounting plate 316 has oblong mounting holes 538. The oblong mounting holes 538 provide an amount of lateral movement of the mounting plate 316, thus allowing the mounting plate to more easily deform. This may result in a more predictable response of the mounting plate 316 when subjected to the tampering force 536.

In order to reduce the possibility of shearing off the locking pin 532, and so disengage the secondary locking mechanism, by forceful rotation of the longitudinal cylinder 520, the coupling of the cam plate 318 to the longitudinal cylinder 520 may be made so as to allow the cam plate 318 and longitudinal cylinder 520 to slip relative to each other. This slippage may be accomplished by sufficiently tightening the nuts 524, 526 securing the cam plate 318 to the longitudinal cylinder 520 so that the longitudinal cylinder 520 and cam plate 318 will be secured and work under normal operation and torque applied to the longitudinal cylinder 520, but will slip when a greater torque is applied. This allows the longitudinal cylinder 520 to rotate, while the cam plate 318 that actuates the locking bars 320 remains secured in position by the secondary locking mechanism.

Figure 6A:
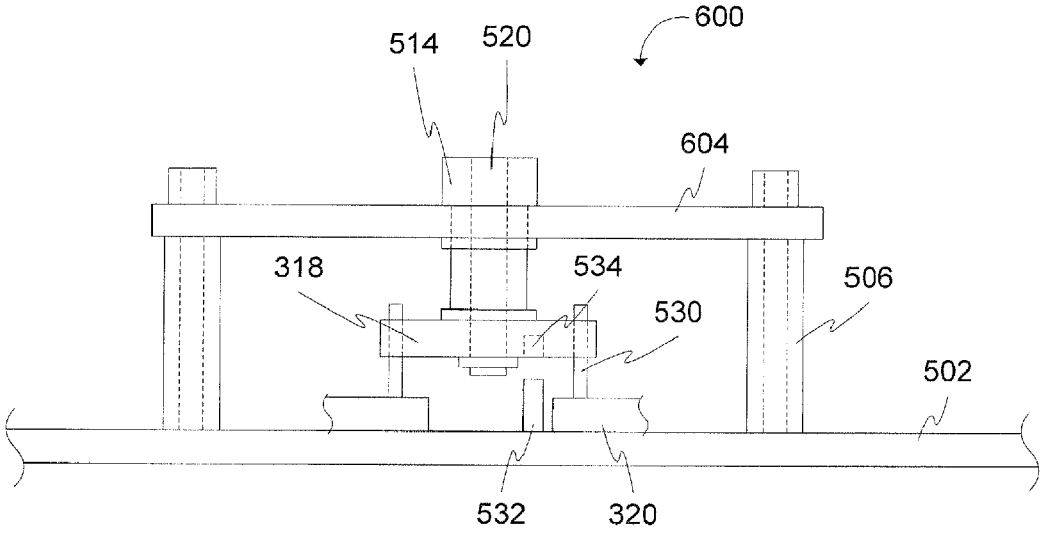
FIG. 6A depicts a further tamper resistant lock in which a secondary locking mechanism has not been engaged.
Figure 6B:
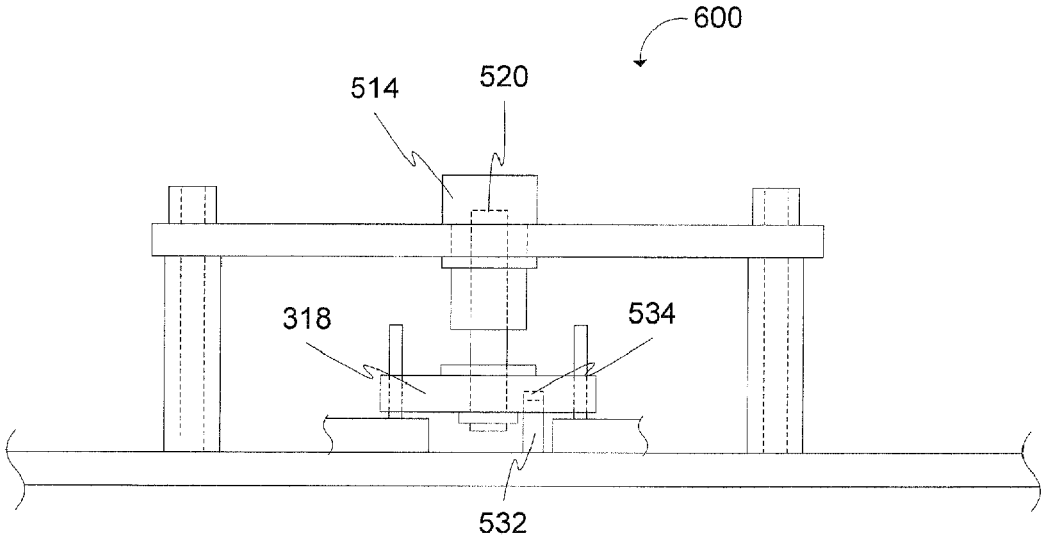
FIG. 6B depicts the tamper resistant lock of FIG. 6A in which the secondary locking mechanism has been engaged.

FIG. 6A depicts in a schematic a tamper resistant lock 600 in which a secondary locking mechanism has not been engaged. FIG. 6B depicts in a schematic the tamper resistant lock 600 in which the secondary locking mechanism has been engaged. The tamper resistant lock 600 is similar to the tamper resistant lock 500 described above. It includes a backing plate 502 with a mounting plate 604 displaced from it by one or more members 506. The tamper resistant lock 600 includes a primary locking mechanism that comprises a longitudinal cylinder 520 mounted within a housing 514 that is securely mounted to the mounting plate 604. A cam plate 318 is coupled to the longitudinal cylinder 520 and rotates between a locked and unlocked position. One or more locking bars 320 are coupled to the cam plate 318 through respective pins 530.

Figure 1A:
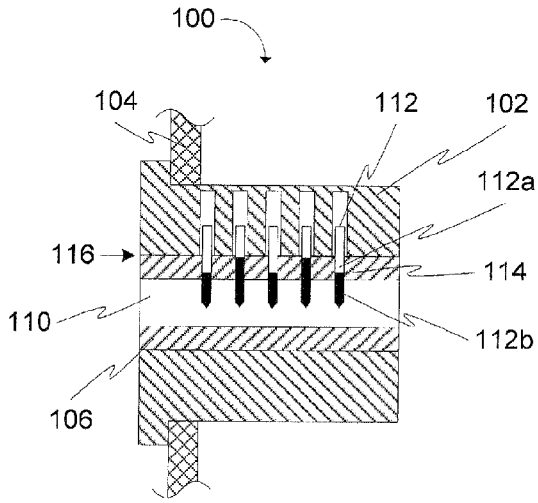
FIGS. 1A to 1D depict a common cylinder lock.
Figure 1B:
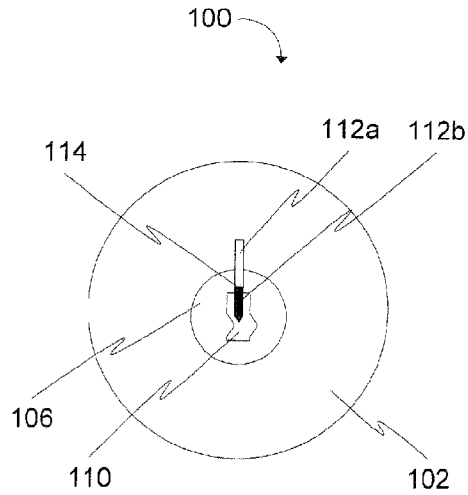
Figure 1C:
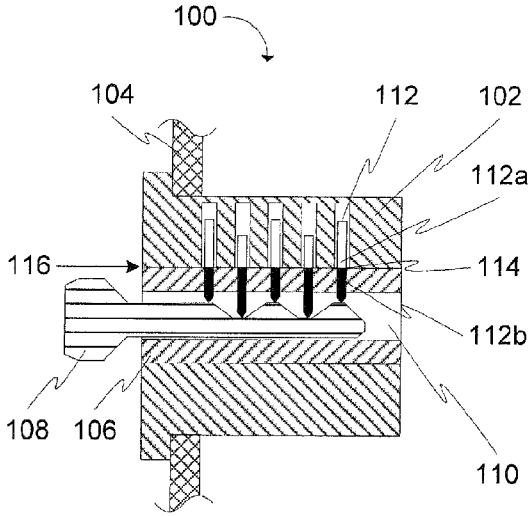
Figure 1D:
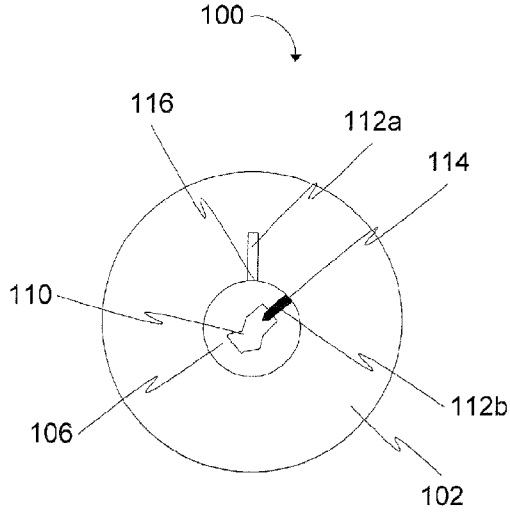
Figure 2A:
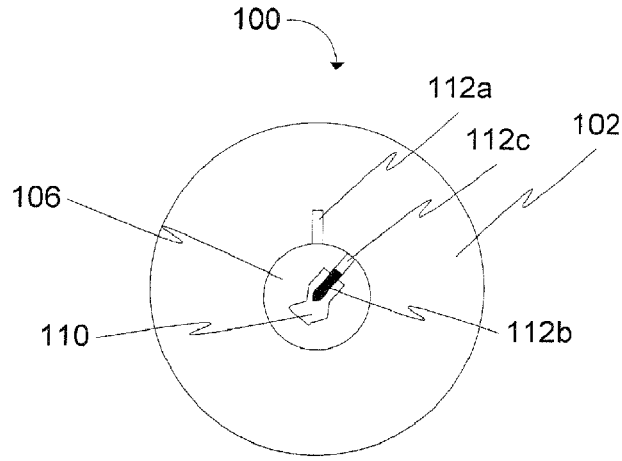
FIGS. 2A and 2B depict failures of a common cylinder lock.
Figure 2B:
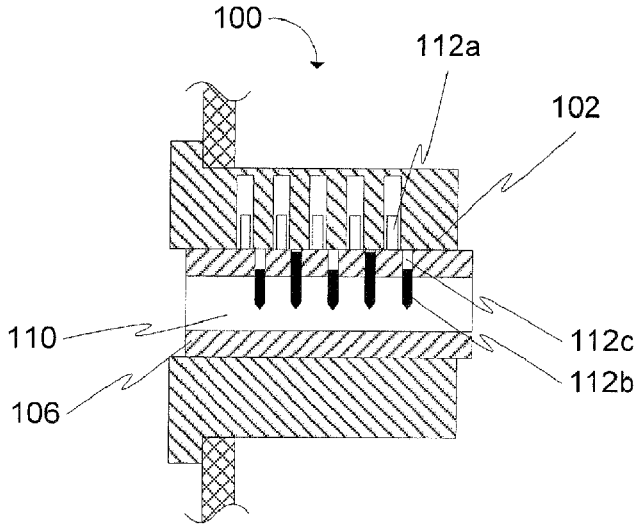

The tamper resistant lock 600 further includes a secondary locking mechanism that, similar to the tamper resistant lock 500, is engaged by the application of a force above a threshold parallel to the longitudinal axis of the longitudinal cylinder 520. The secondary locking mechanism comprises a locking pin 532 that interacts with a locking hole 534 on the cam plate 318 when the secondary locking mechanism is engaged. The secondary locking mechanism also includes an engaging component that allows longitudinal movement of the cam plate when a large force is applied to the longitudinal cylinder 520. However, unlike the tamper resistant lock 500 that used a deformable mounting plate 316, the mounting plate 604 does not deform significantly under the tampering force. In the case of tamper resistant lock 600, the engaging component is provided by the primary locking mechanism. That is, pins of the cylindrical lock act as an engaging component. As described above with reference to FIG. 2B, the pins may shear when a large force is applied to the longitudinal cylinder 520, allowing the longitudinal cylinder 520 to be displaced longitudinally towards the locking pin 532 within the housing 514. The longitudinal movement of the longitudinal cylinder 520 causes the cam plate 318 to be displaced longitudinally and engages the secondary locking mechanism, allowing the locking pin 532 to interact with the locking hole 534 on the cam plate 318. The tamper resistant lock 600 is not able to be unlocked when the secondary locking mechanism is engaged, even if the primary locking mechanism is forcefully damaged.

Figure 7A:
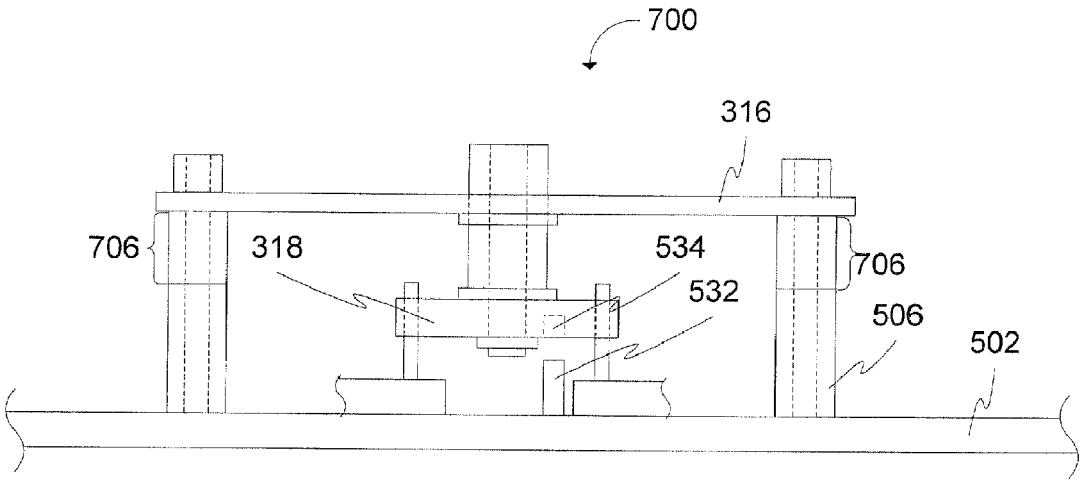
FIG. 7A depicts a still further tamper resistant lock in which a secondary locking mechanism has not been engaged.
Figure 7B:
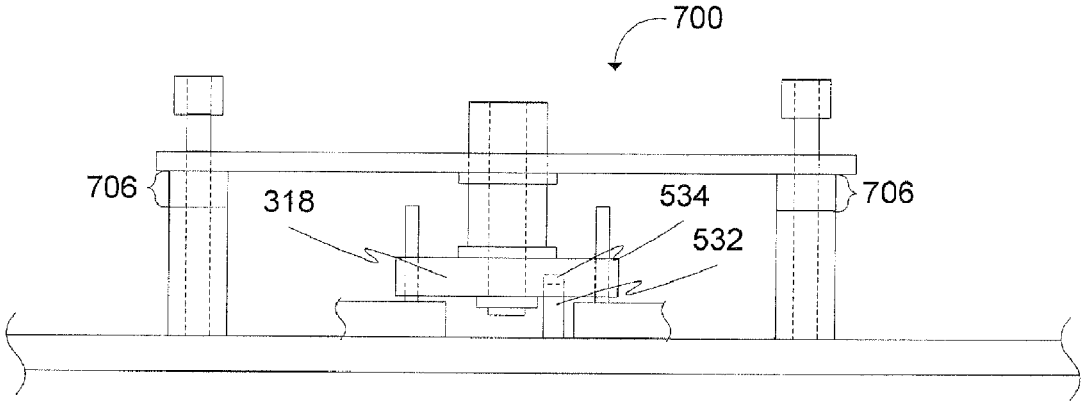
FIG. 7B depicts the tamper resistant lock of FIG. 7A in which the secondary locking mechanism has been engaged.

FIG. 7A depicts in a schematic a tamper resistant lock 700 in which a secondary locking mechanism has not been engaged. FIG. 7B depicts in a schematic the tamper resistant lock 700 in which the secondary locking mechanism has been engaged. The tamper resistant lock 700 is similar both in structure and operation to the tamper resistant locks 500 and 600 described above. As such, the detailed operation of the tamper resistant lock 700 is not described further.

The tamper resistant lock 700 has an engaging component of the secondary locking mechanism that differs from the engaging components of the tamper resistant locks 500 and 600. As depicted in FIG. 7A, the mounting plate 316 is displaced from the backing plate 502 by members 506 and collapsible members 706. As depicted in FIG. 7B, the collapsible members 706 collapse under the tampering force, allowing the mounting plate 316 to move longitudinally towards the locking pin 532. This longitudinal movement allows the locking pin 532 on the backing plate 502 to interact with the locking hole 534 on the cam plate 318, engaging the secondary locking mechanism and preventing the tamper resistant lock 700 from being unlocked by force.

Figure 8A:
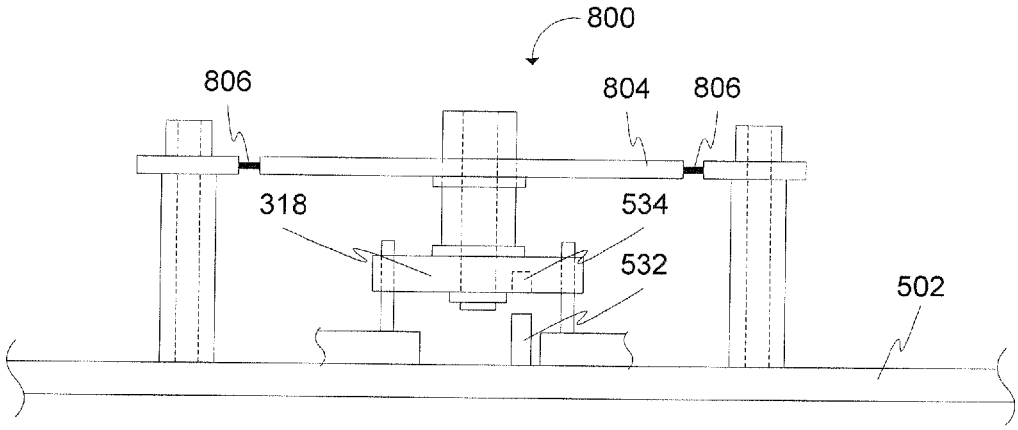
FIG. 8A depicts a still further tamper resistant lock in which a secondary locking mechanism has not been engaged.
Figure 8B:
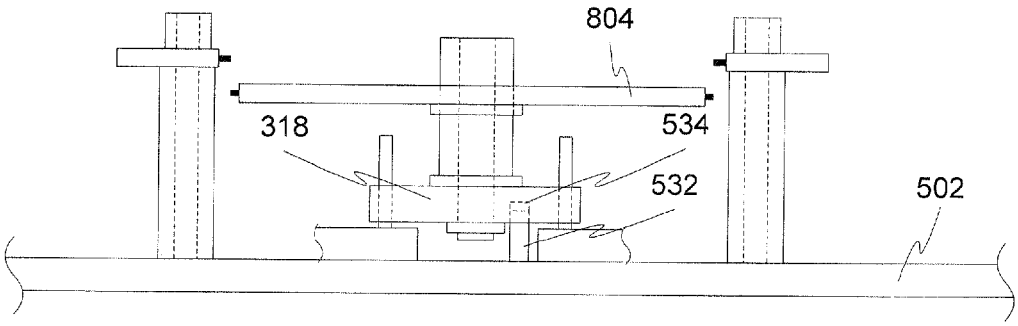
FIG. 8B depicts the tamper resistant lock of FIG. 8A in which the secondary locking mechanism has been engaged.

FIG. 8A depicts in a schematic a tamper resistant lock 800 in which a secondary locking mechanism has not been engaged. FIG. 8B depicts in a schematic the tamper resistant lock 800 in which the secondary locking mechanism has been engaged. The tamper resistant lock 800 is similar both in structure and operation to the tamper resistant locks 500, 600 and 700 described above. As such, the detailed operation of the tamper resistant lock 800 is not described further.

The tamper resistant lock 800 has an engaging component of the secondary locking mechanism that differs from the engaging components of the tamper resistant locks 500, 600 and 700. As depicted in FIG. 8A and FIG. 8B, the mounting plate 804 includes a breakable connection 806. The breakable connection 806 is depicted being adjacent the location of mounting of the mounting plate 804 to the backing plate 502. As evident in FIG. 8B, the breakable connection 804 breaks under the tampering force, allowing the mounting plate 804 to freely move longitudinally towards the backing plate 502. This longitudinal movement allows the locking pin 532 on the backing plate 502 to interact with the locking hole 534 on the cam plate 318, engaging the secondary locking mechanism and preventing the tamper resistant lock 800 from being forcefully unlocked.

The tamper resistant locks 500, 600, 700 and 800 described above have included a secondary locking mechanism that included a locking pin 532 on the backing plate 502 and a corresponding locking hole 534 on a cam plate 318. It will be apparent that the secondary locking mechanism may comprise a plurality of locking pins and corresponding locking holes. Furthermore, the pins and holes may be located on different parts than those described. Further still, it will be appreciated that the secondary locking mechanism does not require the use of a locking pin and locking hole, and may comprise an interacting component having a first interacting component coupled to the longitudinal cylinder and a second corresponding interacting component coupled to the housing.

Figure 9:
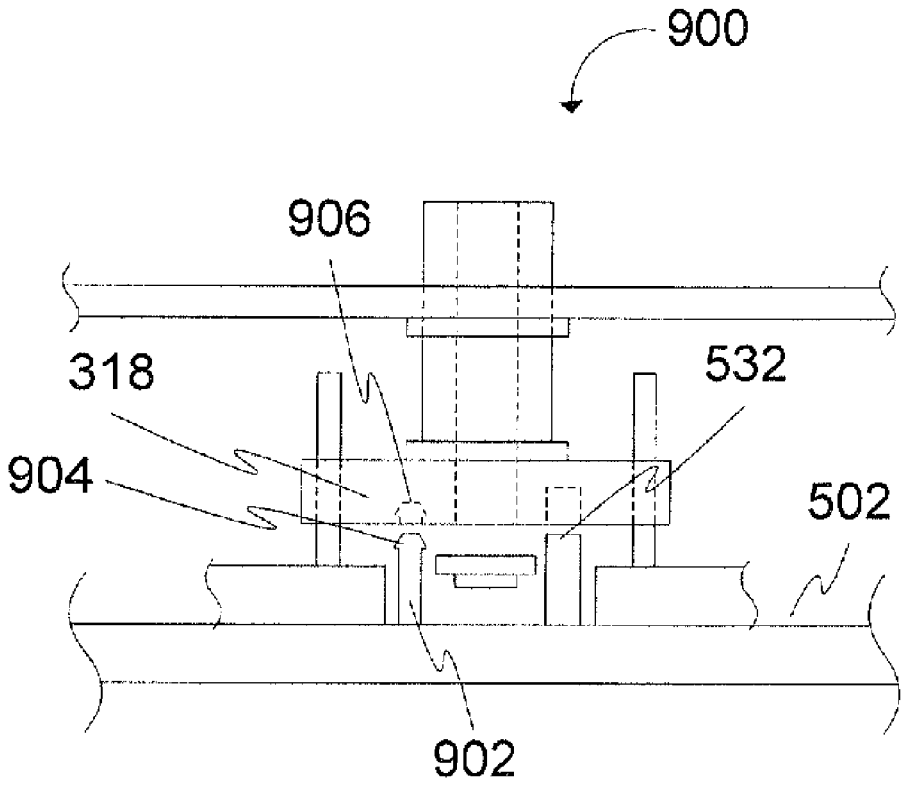
FIG. 9 depicts a partial view of a tamper resistant lock having a tertiary locking mechanism.

FIG. 9 depicts a partial view of a tamper resistant lock 900. The tamper resistant lock 900 may comprise a tamper resistant lock 500, 600, 700 or 800 as described above. The tamper resistant lock 900 further comprises a tertiary locking mechanism for ensuring that the secondary locking mechanism once engaged, remains engaged. The tertiary lock is depicted as a locking pin 902 secured to the backing plate 502 having a barbed head 904 that engages with a corresponding hole 906 in the cam plate 318. The barbed head 904 can be received within the corresponding hole 906; however, the barded head 904 prevents the locking pin 902 from withdrawing from the corresponding hole 906. As such, the cam plate 318 cannot be withdrawn from locking pin 532 of the secondary lock, and so the secondary lock will remain engaged even if the cam plate 318 is attempted to be pulled away from the backing plate 502.

Figure 10A:
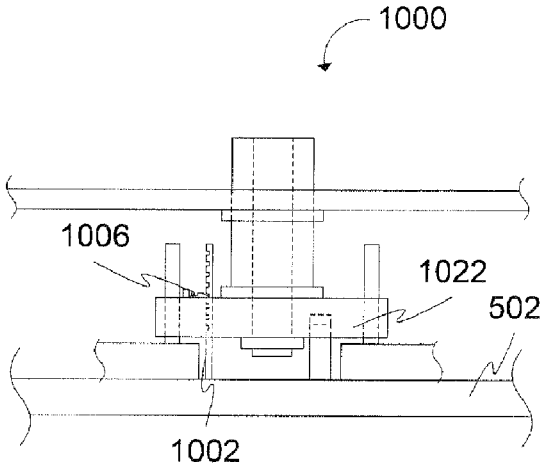
FIG. 10A depicts a partial view of a further tamper resistant lock having a tertiary locking mechanism.

FIG. 10A depicts a partial view of a tamper resistant lock 1000 having a tertiary locking mechanism. The tamper resistant lock 1000 may comprise a tamper resistant lock 500, 600, 700 or 800 as described above. The tamper resistant lock 1000 further includes a tertiary lock for ensuring the cam plate 1022 cannot be pulled away from the backing plate 502, and that the secondary locking mechanism remains engaged once it is engaged. The tertiary locking mechanism comprises a toothed pin 1002 attached to the backing plate 502 and extending through an arcuate opening 1004 (see FIG. 10B) in the cam plate 1022. A spring loaded pawl 1006 is mounted to the cam plate 318 for engaging the toothed locking pin 1002 as the cam plate 1022 lowers. The pawl 1006 ensures that the cam plate 1022 cannot be pulled away from the backing plate 502 in order to disengage the secondary locking mechanism.

Figure 10B:
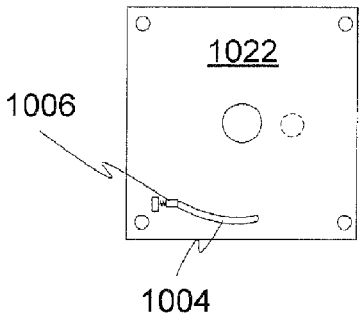
FIG. 10B depicts a cam plate of the tamper resistant lock of FIG. 10A.

FIG. 10B depicts a cam plate 1022 for use with the toothed locking pin 1002. Similar to the cam plate 318, the cam plate 1022 includes mounting holes for receiving connecting pins of locking bars. The cam plate 1022 includes an off center locking hole and a hole for receiving the longitudinal cylinder of the primary locking mechanism. The cam plate 1022 further includes an arcuate opening 1004 for the toothed pin 1002 to pass through while allowing the cam plate 1022 to freely rotate between the locked and unlocked positions. The pawl 1006 may be mounted on either side of the cam plate 1022.

The force that may be applied to pull the cam plate away from the backing plate may not be large as there are limited locations for applying the force. As such, the tertiary lock as described in either of FIG. 9, 10A or 10B does not need to be as strong as the secondary locking mechanism.

Figure 11A:
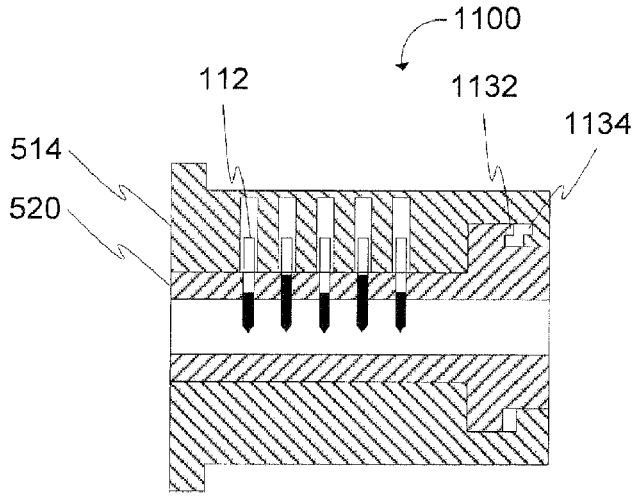
FIG. 11A depicts another tamper resistant lock in which a secondary locking mechanism has not been engaged.
Figure 11B:
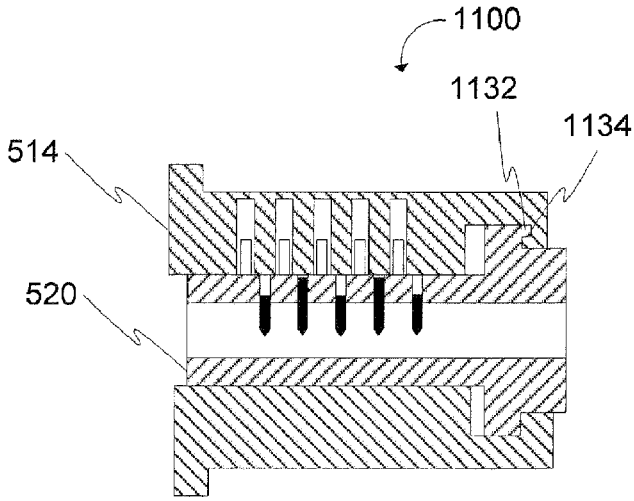
FIG. 11B depicts the tamper resistant lock of FIG. 11A in which the secondary locking mechanism has been engaged.

FIG. 11A depicts a tamper resistant lock 1100 with the secondary locking mechanism not engaged. FIG. 11B depicts the tamper resistant lock 1100 with the secondary locking mechanism engaged. The tamper resistant lock 1100 includes a longitudinal cylinder 520 housed within a housing. The lock 1100 includes a plurality of locking pins 112 for locking or unlocking the rotation of the longitudinal cylinder within the housing 514. When a longitudinal force sufficient to shear the locking pins is applied to the longitudinal cylinder 520, the longitudinal cylinder 520 will be displaced longitudinally within the housing 514, bringing a locking pin 1132 of the secondary locking mechanism into engagement with a corresponding locking hole 1134, engaging the secondary locking mechanism and preventing rotation of the longitudinal cylinder 520 within the housing 514.

Although not depicted in FIG. 11A or 11B, the tamper resistant lock 1100 may include a tertiary locking mechanism for preventing the longitudinal cylinder 520 from being retracted from within the housing 514, and so ensuring the secondary locking mechanism remains engaged.

A tamper resistant lock has been described by way of several variations. It will be appreciated that components of one variation may be incorporated into other variations. Furthermore, variations and modifications not described herein will be apparent to one of ordinary skill in the art having regard to the description herein.

What is claimed is:

1. A tamper resistant lock comprising:

a primary locking mechanism having a longitudinal cylinder within a housing, the longitudinal cylinder rotatable within the housing, the longitudinal cylinder coupled to an actuator that is rotatable between a locked position and an unlocked position when an appropriate key is received within the longitudinal cylinder;

a secondary locking mechanism to prevent rotation of the actuator when a tampering force parallel to a longitudinal axis of the longitudinal cylinder is applied to the primary locking mechanism, the secondary locking mechanism, when engaged, coupling the actuator to the housing of the primary locking mechanism.

2. The tamper resistant lock of claim 1, wherein the secondary locking mechanism comprises:

a first interacting component coupled to the longitudinal cylinder;

a second interacting component coupled to the housing, longitudinally spaced from the first interacting component and aligned for engaging the first interacting component; and an engaging component allowing longitudinal movement of the first interacting component relative to the second interacting component, whereby the first interacting component engages with the second interacting component when the tampering force is greater than a threshold.

3. The tamper resistant lock of claim 2, wherein the engaging component further prevents longitudinal movement of the first interacting component relative to the second interacting component when the tampering force is less than the threshold.

4. The tamper resistant lock of claim 2, further comprising a backing plate, wherein the engaging component is coupled to the housing of the primary locking mechanism and mounts the primary locking mechanism apart from the backing plate.

5. The tamper resistant lock of claim 4, wherein the engaging component comprises a mounting plate displaced from the backing plate by one or more members and wherein the housing of the primary locking mechanism is secured to the mounting plate.

6. The tamper resistant lock of claim 4, wherein the first interacting component is located off of a center of rotation of the longitudinal cylinder and the second interacting component is located on the backing plate.

7. The tamper resistant lock of claim 6, wherein the first interacting component comprises a hole and the second interacting component comprises a pin sized to be received in the hole when the first interacting component is engaged with the second interacting component.

8. The tamper resistant lock of claim 6, wherein the first interacting component comprises a pin and the second interacting component comprises a hole sized to receive the pin when the first interacting component is engaged with the second interacting component.

9. The tamper resistant lock of claim 5, wherein the mounting plate deforms under the tampering force to longitudinally move the primary locking mechanism towards the backing plate.

10. The tamper resistant lock of claim 2, wherein the actuator comprises a cam plate attached to the longitudinal cylinder, and wherein the first interacting component is located on the cam plate.

11. The tamper resistant lock of claim 10, further comprising one or more locking bars coupled to the cam plate for retracting or extending from the tamper resistant lock when the longitudinal cylinder is rotated within the housing.

12. The tamper resistant lock of claim 10, wherein the cam plate is coupled to the longitudinal cylinder to allow the longitudinal cylinder to rotate when a sufficient torque is applied to the longitudinal cylinder with the secondary locking mechanism engaged.

13. The tamper resistant lock of claim 2, wherein the engaging component comprises one of:

a deformable mounting plate;

a mounting plate having a breakable connection;

a collapsible member mounting a mounting plate above a backing plate; or shearable pins of the primary locking mechanism.

14. A securable device comprising:

a body having an interior space to be secured;

an access panel in the body; and a tamper resistant lock according to claim 1 preventing forceful opening of the access panel.

15. The securable device of claim 14, wherein the securable device comprises:

a parking meter;

a vending machine;

an electrical cabinet; or a telecommunications cabinet.

* * * * *